US006840380B1

(12) United States Patent
Gambale

(10) Patent No.: US 6,840,380 B1
(45) Date of Patent: Jan. 11, 2005

(54) GIFT MANAGEMENT KIT

(76) Inventor: Chasey M. Gambale, 8298 Dixie Ct., Manassas, VA (US) 20110

( * ) Notice: Subject to any disclaimer, the term of this patent is extended or adjusted under 35 U.S.C. 154(b) by 276 days.

(21) Appl. No.: 10/255,851

(22) Filed: Sep. 25, 2002

(51) Int. Cl.[7] ..... B65D 5/42
(52) U.S. Cl. ..... 206/575; 206/457; 229/922
(58) Field of Search ..... 229/116.5, 125.22, 229/125.38, 922, 923; 206/575, 223, 372, 373, 457

(56) References Cited

U.S. PATENT DOCUMENTS 4,185,767 A * 1/1980 Sykora et al. ..... 229/138
4,726,509 A * 2/1988 Fonas ..... 229/116.1
5,392,983 A * 2/1995 Clarke-Bolling et al. 229/87.19
5,497,876 A * 3/1996 Fleming ..... 206/232
6,601,757 B2 * 8/2003 Bowman ..... 229/116.5

* cited by examiner

*Primary Examiner*—Jacob K. Ackun, Jr.

(57) ABSTRACT

Gift management kits are desirable for opening, assembling, and cleaning up gifts. Gift giving occasions, such as Christmas, frequently result in a number of presents which must be opened and assembled. Used wrapping paper is also created which must be disposed of. Gift management kits provide easy access to a complete set of commonly needed tools for opening, assembling, and cleaning up gifts. The tools include garbage bags, wire cutters, a Philips head screwdriver, a Flathead screwdriver, a box cutters, a wrench, scissors, batteries, and nail clippers. Furthermore, the gift management kit can be disguised as a present, making it readily available yet unobtrusive during gift giving occasions.

20 Claims, 2 Drawing Sheets

GIFT MANAGEMENT KIT

BACKGROUND OF THE INVENTION

1. Field of the Invention

The present invention relates to a gift management kit for use in connection with presents. The gift management kit has particular utility in connection with opening, assembling, and cleaning up gifts.

2. Description of the Prior Art

Gift management kits are desirable for opening, assembling, and cleaning up gifts. Gift giving occasions, such as Christmas, frequently result in a number of presents which must be opened and assembled. Used wrapping paper is also created which must be disposed of. Many times, delay in the use of a present results from the proper tools not being available to assemble and/or operate it. Gift management kits provide easy access to a complete set of commonly needed tools for opening, assembling, and cleaning up gifts. Furthermore, the gift management kit can be disguised as a present, making it readily available yet unobtrusive during gift giving occasions.

The use of toolboxes is known in the prior art. For example, U.S. Pat. No. 6,216,858 to Chiu discloses a toolbox. However, the Chiu '858 patent does not have a detachable lid, and has further drawbacks of not resembling a present.

U.S. Pat. No. 5,441,163 to Carrasco discloses a portable tool container that includes a cylindrically shaped base with a flat bottom. However, the Carrasco '163 patent does not have tools, and additionally does not resemble a present.

Similarly, U.S. Pat. No. Des. 380,154 to Ryan discloses a decorative box that has frills attached to its upper flaps. However, the Ryan '154 patent does not have a detachable lid, and cannot be used to open, assemble, or clean up gifts.

In addition, U.S. Pat. No. 5,676,253 to Hsu discloses a combination-type toolbox that comprises a polygonal main body. However, the Hsu '253 patent does not have tools, and also does not resemble a present.

Furthermore, U.S. Pat. No. 5,004,103 to Connors et al. discloses a tool storage box that stores punches and dies for the production of pharmaceutical tablets and caplets. However, the Connors et al. '103 patent does not have tools, and further lacks resemblance to a present.

Lastly, U.S. Pat. No. 4,185,767 to Sykora et al. discloses an ornamental package structure that packages a product. However, the Sykora et al. '767 patent does not have a detachable lid, and has the additional deficiency of lacking tools.

While the above-described devices fulfill their respective, particular objectives and requirements, the aforementioned patents do not describe a gift management kit that allows opening, assembling, and cleaning up gifts. The Chiu '858 patent, the Ryan '154 patent, and the Sykora et al. '767 patent make no provision for a detachable lid. The Chiu '858 patent, the Carrasco '163 patent, the Hsu '253 patent, and the Connors et al. '103 patent do not resemble a present. The Carrasco '163 patent, the Ryan '154 patent, the Hsu '253 patent, the Connors et al. '103 patent, and the Sykora et al. '767 patent lack tools.

Therefore, a need exists for a new and improved gift management kit that can be used for opening, assembling, and cleaning up gifts. In this regard, the present invention substantially fulfills this need. In this respect, the gift management kit according to the present invention substantially departs from the conventional concepts and designs of the prior art, and in doing so provides an apparatus primarily developed for the purpose of opening, assembling, and cleaning up gifts.

SUMMARY OF THE INVENTION

In view of the foregoing disadvantages inherent in the known types of toolboxes now present in the prior art, the present invention provides an improved gift management kit, and overcomes the above-mentioned disadvantages and drawbacks of the prior art. As such, the general purpose of the present invention, which will be described subsequently in greater detail, is to provide a new and improved gift management kit which has all the advantages of the prior art mentioned heretofore and many novel features that result in a gift management kit which is not anticipated, rendered obvious, suggested, or even implied by the prior art, either alone or in any combination thereof.

To attain this, the present invention essentially comprises a hollow box with an open top and a removable lid. A first ribbon is attached to the exterior sides of the box, and a second ribbon is attached to the exterior sides and top of the lid. A tool resides inside the box.

There has thus been outlined, rather broadly, the more important features of the invention in order that the detailed description thereof that follows may be better understood and in order that the present contribution to the art may be better appreciated.

The invention may also include a bow been attached to the top of the second ribbon or to the top of the lid. The first ribbon may be centered on the exterior sides of the box. The second ribbon may be centered on the exterior sides of the lid and form a plus-sign on the top of the lid. The box and lid may be made of cardboard, plastic, aluminum, titanium, steel, or carbon fiber composite. The tool may be one or more of the group consisting of garbage bags, cutters, screwdrivers, wrenches, scissors, batteries, and nail clippers. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gift management kit that has all of the advantages of the prior art toolboxes and none of the disadvantages.

It is another object of the present invention to provide a new and improved gift management kit that may be easily and efficiently manufactured and marketed.

An even further object of the present invention is to provide a new and improved gift management kit that has a low cost of manufacture with regard to both materials and labor, and which accordingly is then susceptible of low prices of sale to the consuming public, thereby making such gift management kit economically available to the buying public.

Still another object of the present invention is to provide a new gift management kit that provides in the apparatuses and methods of the prior art some of the advantages thereof, while simultaneously overcoming some of the disadvantages normally associated therewith.

Even still another object of the present invention is to provide a gift management kit for opening, assembling, and cleaning up gifts. This allows the user to disguise the presence of the gift management kit.

Still yet another object of the present invention is to provide a gift management kit for opening, assembling, and cleaning up gifts. This makes it possible to easily open presents.

An additional object of the present invention is to provide a gift management kit for opening, assembling, and cleaning up gifts. This provides convenient access to tools commonly required to assemble and operate presents.

A further object of the present invention is to provide a gift management kit for opening, assembling, and cleaning up gifts. This provides convenient access to tools commonly required to clean up presents.

Lastly, it is an object of the present invention to provide a new and improved gift management kit for opening, assembling, and cleaning up gifts.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
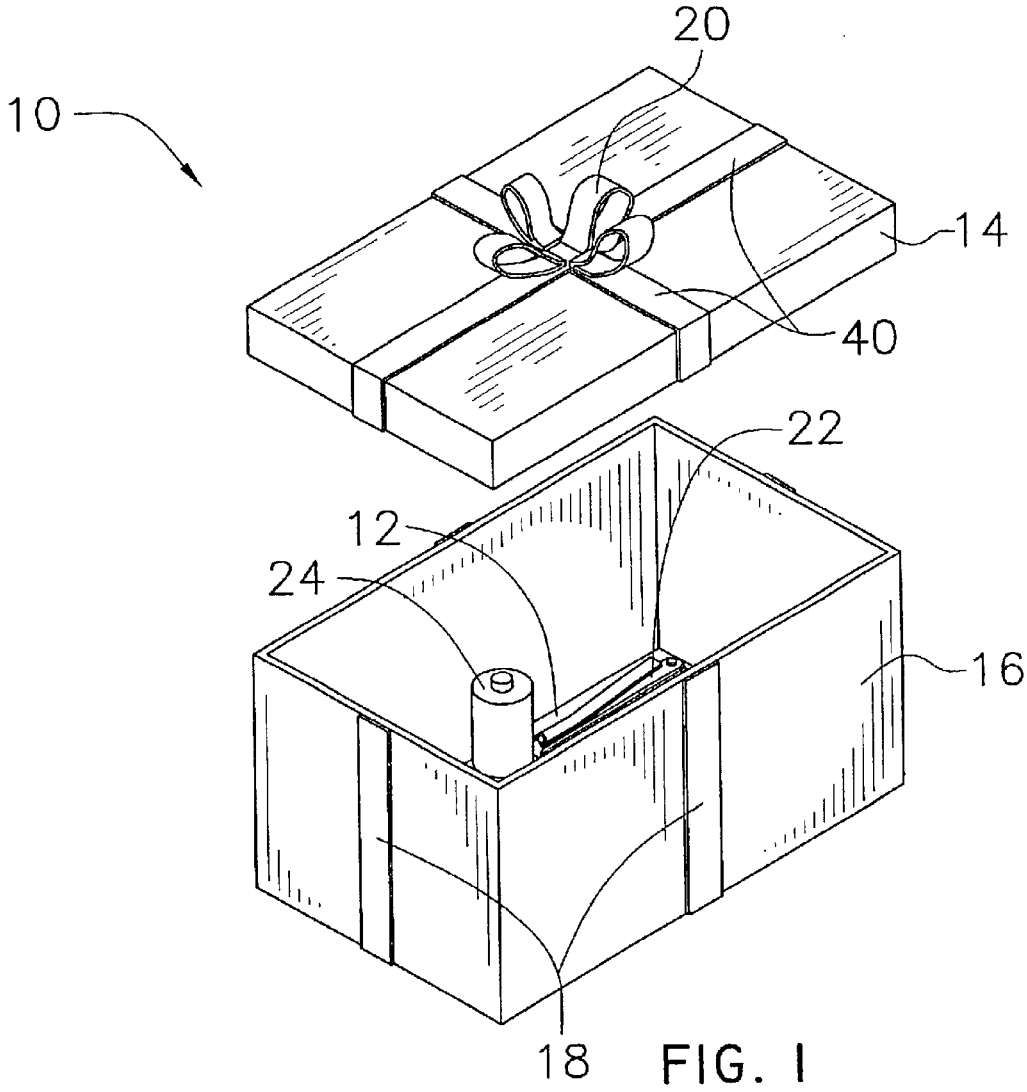
FIG. 1 is a top perspective exploded view of the current embodiment of the gift management kit constructed in accordance with the principles of the present invention.
Figure 2:
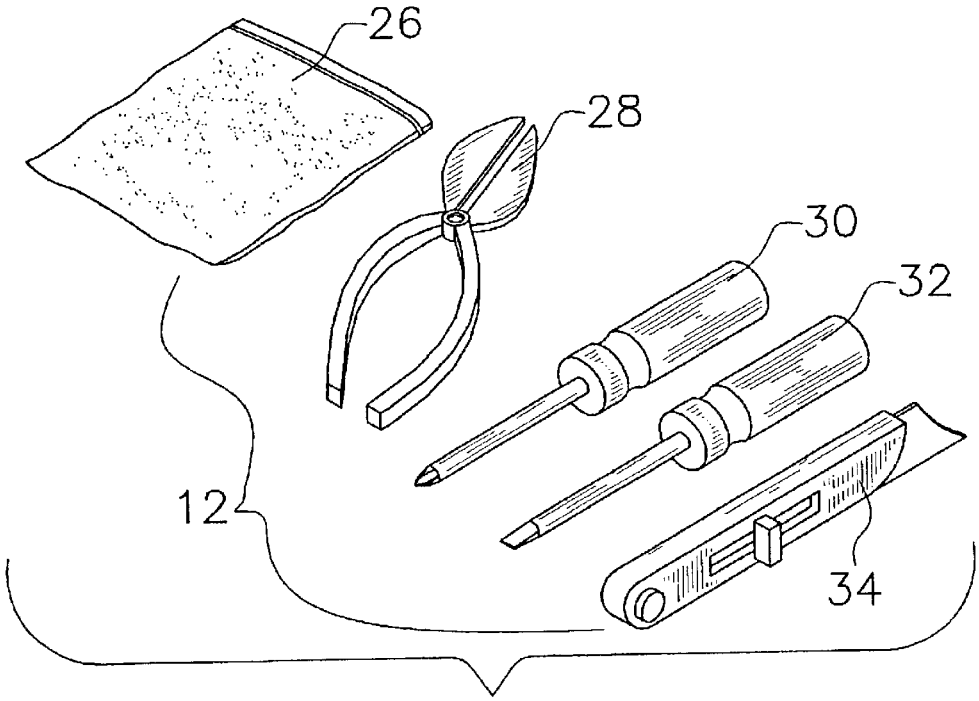
FIG. 2 is a top perspective view of the tools of the present invention.
Figure 3:
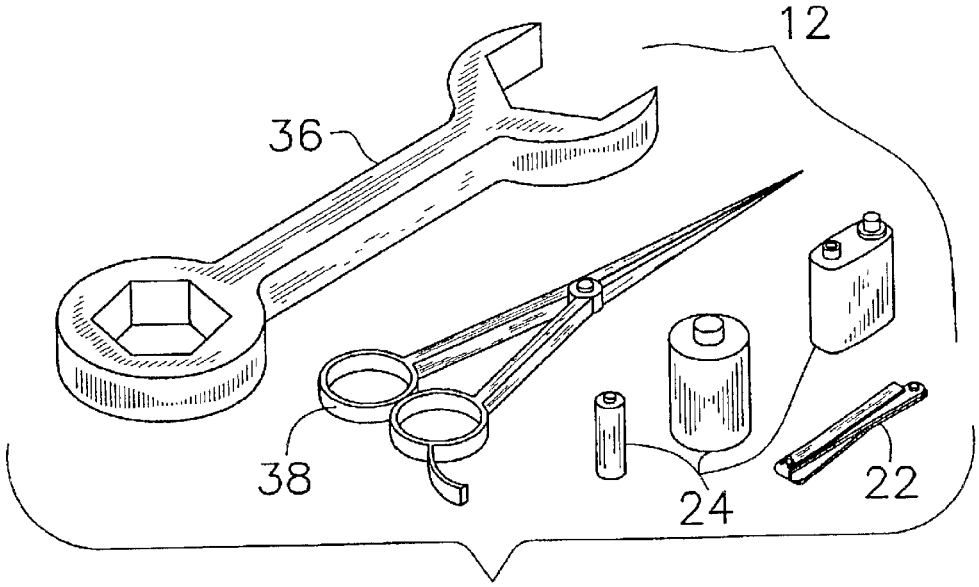
FIG. 3 is a top perspective view of the tools of the present invention.

Referring now to the drawings, and particularly to FIGS. 1–3, a current embodiment of the gift management kit of the present invention is shown and generally designated by the reference numeral 10.

In FIG. 1, a new and improved gift management kit 10 of the present invention for opening, assembling, and cleaning up gifts is illustrated and will be described. More particularly, the gift management kit 10 has tools 12 enclosed by box 16. The tools 12 visible in FIG. 1 are a battery 24 and nail clippers 22. Box 16 has an open top and is made of cardboard in the current embodiment. Lid 14 is removably attached to the top of box 16. In the current embodiment, lid 14 is made of cardboard. First ribbon 18 is attached to the exterior sides of box 16, and second ribbon 40 is attached to the exterior sides of lid 14 and to the top of lid 14. In the current embodiment, first ribbon 18 is centered on the exterior sides of box 16, and second ribbon 40 is centered on the exterior sides of lid 14 and forms a plus-sign atop lid 14.

Moving on to FIG. 2, new and improved tools 12 of the present invention for opening, assembling, and cleaning up gifts are illustrated and will be described. More particularly, the tools 12 comprise a garbage bag 26, wire cutters 28, Phillips said screwdriver 30, Flathead screwdriver 32, and box cover 34. Garbage bag 26 is used to dispose of use wrapping paper. Wire cutters 28, Phillips said screwdriver 30, and Flathead screwdriver 32 are used to open and assemble presents. Box cutter 34 is used to open presents.

Concluding with FIG. 3, new and improved tools 12 of the present invention for opening, assembling, and cleaning up gifts are illustrated and will be described. More particularly, the tools 12 further comprise a wrench 36, scissors 38, batteries 24, and nail clippers 22. The wrench 36 is used to assemble presents. The scissors 38 and nail clippers 22 are used to open and assemble presents. The batteries 24 are used to operate presents.

In use, it can now be understood that the user places the gift management kit 10 with other presents in anticipation of a gift giving occasion. The gift management kit 10 is disguised by its present-like appearance. When the gift giving occasion arrives, the user opens the gift management kit 10 by removing lid 14 from box 16, and then removes tools 12 from box 16 as needed. At the conclusion of the gift giving occasion, tools 12 are returned to box 16, lid 14 is replaced atop box 16, and the gift management kit 10 is stored for future use.

While a current embodiment of the gift management kit has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, plastic, aluminum, titanium, wood, or carbon fiber composite may be used instead of the cardboard box and lid described. Also, the tools may also be selected from additional items to match the opening, assembling, and cleaning up needs presented by various gifts. And although opening, assembling, and cleaning up gifts have been described, it should be appreciated that the gift management kit herein described is also suitable for a variety of household tasks requiring the use of tools. Furthermore, a wide variety of ribbon and bow placements may be used instead of the centered on the exterior sides of the box and lid with a plus-sign on the top of the lid described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gift management kit comprising:

a hollow box having an open top, exterior sides, and a top edge;

a lid having a top, exterior sides, and a bottom with said bottom removably contacting said top edge of said box;

a first ribbon attached to said exterior sides of said box;

a second ribbon having a top attached to said exterior sides of said lid and said top of said lid; and a tool enclosed by said box.

2. The gift management kit as defined in claim 1, wherein said tool is at least one of the group consisting of garbage bags, cutters, screwdrivers, wrenches, scissors, batteries, and nail clippers.

3. The gift management kit as defined in claim 2, wherein said cutters are at least one of the group consisting of wire cutters and box cutters.

4. The gift management kit as defined in claim 2, wherein said screwdrivers are at least one of the group consisting of Philips head screwdrivers and Flathead screwdrivers.

5. The gift management kit as defined in claim 2, wherein said batteries are at least one of the group consisting of AAA batteries, AA batteries, C batteries, D batteries, and 9 volt batteries.

6. The gift management kit as defined in claim 1, further comprising a bow attached to said top of said second ribbon.

7. The gift management kit as defined in claim 1, wherein said first ribbon is centered on said exterior sides of said box.

8. The gift management kit as defined in claim 1, wherein said second ribbon is centered on said exterior sides of said lid.

9. The gift management kit as defined in claim 1, wherein said second ribbon forms a plus-sign atop said lid.

10. The gift management kit as defined in claim 2, wherein said wrenches are at least one of the group consisting of adjustable crescent wrenches, socket wrenches, Allen wrenches, metric wrenches, and imperial wrenches.

11. A gift management kit comprising:

a garbage bag;

a cutter;

a screwdriver;

a wrench;

scissors;

batteries; and nail clippers.

12. The gift management kit as defined in claim 11, wherein said cutters are at least one of the group consisting of wire cutters and box cutters.

13. The gift management kit as defined in claim 11, wherein said screwdrivers are at least one of the group consisting of Philips head screwdrivers and Flathead screwdrivers.

14. The gift management kit as defined in claim 11, wherein said batteries are at least one of the group consisting of AAA batteries, AA batteries, C batteries, D batteries, and 9 volt batteries.

15. The gift management kit as defined in claim 2, wherein said wrenches are at least one of the group consisting of adjustable crescent wrenches, socket wrenches, Allen wrenches, metric wrenches, and imperial wrenches.

16. A packaged gift management kit, which comprises the gift management kit of claim 11 inside of a package or container.

17. The packaged gift management kit as defined in claim 16, wherein said package comprises:

a hollow box having an open top, exterior sides, and a top edge; and a lid having a top, exterior sides, and a bottom with said bottom removably contacting said top edge of said box.

18. The packaged gift management kit as defined in claim 17, further comprising:

a first ribbon attached to said exterior sides of said box; and a second ribbon having a top attached to said exterior sides of said lid and said top of said lid.

19. The packaged gift management kit as defined in claim 17, further comprising a bow attached to said top of said lid.

20. The packaged gift management kit as defined in claim 17, wherein said box and said lid are selected from the group consisting of cardboard, plastic, aluminum, titanium, steel, wood, and carbon fiber composite.

* * * * *